US005148173A

United States Patent [19]

Rouse et al.

[11] Patent Number: 5,148,173

[45] Date of Patent: Sep. 15, 1992

[54] MILLIMETER WAVE SCREENING CLOUD AND METHOD

[75] Inventors: William G. Rouse, Aberdeen, Md.; Connie S. Kilgore, Delta, Pa.; Ronald E. Rhea, Bel Air; Michael J. Burnham, Kingsville, both of Md.; Benjamin G. Wachob, Boulder, Colo.

[73] Assignee: The United States of America as represented by the Secretary of the Army, Washington, D.C.

[21] Appl. No.: 687,113

[22] Filed: Apr. 15, 1991

[51] Int. Cl.[5] ..... F42B 12/70; H01Q 17/00

[52] U.S. Cl. ..... 342/3; 342/12; 102/505

[58] Field of Search ..... 342/12, 3; 102/505

[56] References Cited

U.S. PATENT DOCUMENTS 4,704,967 11/1987 Milstead et al. ..... 102/505 X 4,808,481 2/1989 Luxon ..... 428/407

*Primary Examiner*—Gilberto Barrón, Jr.

*Attorney, Agent, or Firm*—Anthony T. Lane; Edward Goldberg; Edward F. Costigan

[57] ABSTRACT

A millimeter wave screening cloud is formed comprised of an aerosol of fine fibers of a carbon composition, in which the particles are of micron diameter and millimeter length. The cloud is formed by aerosolizing a compact mass of carbon composition fibers through the action of explosively bursting such compact mass in the atmosphere at the desired cloud location.

3 Claims, No Drawings

MILLIMETER WAVE SCREENING CLOUD AND METHOD

GOVERNMENTAL INTEREST

The invention described herein may be manufactured, used and licensed by or for the Government for governmental purposes without payment to us of any royalties thereon.

FIELD OF USE

This invention relates to a millimeter wave screening cloud and a method of forming such a cloud.

BACKGROUND OF THE INVENTION

Efforts to develop a millimeter wave screening cloud that will protect military equipment from radar detection and allow improved survivability have been underway for a number of years. Various military vehicles are conventionally equipped with smoke grenades and suitable launchers, such as launching tubes or barrels, single or in clusters, whereby the grenades are launched to provide a protective screen relative to the vehicle.

SUMMARY OF THE INVENTION

It is an object of the present invention to provide a method for dissemination of millimeter wave screening composition in a manner compatible with current vehicle mounted smoke grenade launcher systems, so as to form an effective protective screening cloud.

Screening effectiveness is optimized by bursting in mid-air a high explosive central burster surrounded by densely compacted special carbon composition, compatible with the high explosive enabling the use of a volume-limited devise such as a conventional screening grenade which may be launched from a conventional launch tube.

A further object is the forming of a millimeter wave screening cloud of substantial effectiveness.

Still other objects, features and attendant advantages will become more apparent from a reading of the following detailed description of an illustrative embodiment and mode of practice of the invention.

PREFERRED EMBODIMENT

A millimeter wave screening cloud is formed in the atmosphere by projecting one or more burstable containers, such as conventional screening grenades, into the atmosphere at the desired location for formation of a screening cloud. This may be effected by launching grenades from a screening vehicle, as by use of conventional multiple launch tubes in a launcher mounted on the vehicle.

The screening cloud is formed of fine carbon particles in which the particles arc of 3–7 micron diameter and 3–15 millimeter length. It has been found that a polyacrylonitrile based carbon fiber that has been epoxy sized and desized and cut to an appropriate length, approximately ½ the wave length of the frequency to be screened, provides an effective millimeter wave screening cloud.

Celion C-6NS chopped carbon fibers, similar to those which are employed as reinforcement in nylon molding compounds, have been found to be highly suitable for practice of this invention.

These particles are suitably compacted to a density of about0.8gm/cm2, in a configuration which enables ready explosive bursting to effect aerosolizing of the particles in the atmosphere to thereby form the desired screening cloud.

It has been found that a hollow cylindrical or tubular shape is a desirable configuration to enable both adequate bursting of the compact particles, and also to enable its use in a conventional launchable grenade form.

In forming the millimeter wave screening cloud, the compacted hollow cylindrical mass of carbon fibers is explosively burst in the atmosphere by an high explosive charge mass which is disposed within the hollow cylindrical compacted mass of particles. The term high explosive is generally accepted as being a composition whose consumption rate is 20,000 feet per second or more.

A ratio of the weight of the compacted mass of material relative to the high explosive charge mass may be employed within the general range of approximately 20:1 to 60:1, with an optimum ratio being approximately 40:1, particularly for carbon fiber. This yields maximum millimeter wave screening attenuation over an adequate area to screen the source vehicle and surrounding personnel or vehicles from enemy weapons and enemy personnel, consistent with the conventional grenade volume constraints imposed by launching from a conventional launch tube of relatively small size.

A particular advantage of the special carbon composition, for the compacted material is the ability of these fibers to provide a highly effective millimeter wave screening cloud while not disintegrating or igniting as a result of the explosive bursting of the compact mass by the high explosive.

It has been found that clouds 4 to 6 meters in diameter may be readily formed according to the invention with excellent attenuation throughout the millimeter wavelength regions.

A suitable vehicle for carrying out the method and forming a screening cloud according to the invention is a conventional self-propelled grenade which is launchable from a conventional launch tube mounted on a vehicle or otherwise as desired.

The conventional grenade has a frangible plastic body within which is a hollow cylinder or tube of compacted carbon particles as previously described. With the hollow cylindrical mass of compacted particles is a cylinder of high explosive, which may be of any conventional high explosive composition. A guide tube and support tube may be employed between the hollow cylindrical mass and the cylindrical high explosive mass with a plastic cover suitably secured over the end thereof, as by ultrasonic welding.

The grenade is self-propelled by a propellant charge which may be ignited as by an electric squib or electric match. The propellant gases produced vent through thin-walled blow-outs in a propellant cover.

A suitable pyrotechnic time delay may be ignited directly by the burning propellant to enable a desired time delay after launch before burst of the high explosive charge.

One or more percussive detonators which may be of successively increasing power, may be employed in the ignition/detonation path leading to the high explosive mass. In one embodiment, an ignitable, relatively low power, detonator would activate a higher power conventional booster lead, which in turn would set off an explosion of the high explosive mass, to thereby effectively break the plastic body and aerosolize and disperse the mass of carbon fibers and thus form a desired millimeter wave screening cloud in the atmosphere at the desired location.

By launching multiple grenades from launchers over a desired area, it will be appreciated that a screening cloud of desired size may be formed so as to screen a relatively wide area from enemy weapons and enemy personnel.

The foregoing disclosure is merely illustrative of the principles of this invention and is not to be interpreted in a limiting sense. We wish it to be understood that we do not desire to be limited to the described because obvious modifications will occur to a person skilled in the art.

What is claimed is:

1. In an improved method of screening against millimeter wave transmission, the improvement comprising injecting into the atmosphere a screening cloud of fine particles comprised of carbon compositions selected from the group consisting of graphitized carbon fibers and polyacrylonitrile based precursors including cutting said fibers to one half the wavelength of the desired frequency to be screened, said particles are epoxy sized and desized and of a particular size of about 3 to about 7 microns in diameter, forming said cloud by bursting a compacted generally cohesive solid mass of said particles in the atmosphere by a high explosive charge within said compacted mass of said carbon composition to thereby aerosolize and disperse said particles in the atmosphere.

2. The method according to claim 1, wherein the ratio of the weights of said compacted cohesive mass of particles relative to said high explosive charge being within the range of about 20:1 and about 60:1.

3. The method according to claim 2, wherein the screening cloud is effective in the millimeter region of the electromagnetic spectrum.

* * * * *